US006032996A

United States Patent [19]

Kogen

[11] Patent Number: 6,032,996

[45] Date of Patent: Mar. 7, 2000

[54] EXTENDED MULTI-FUNCTION IMPLEMENT FOR FACILITATING DRESSING

[75] Inventor: Robert A. Kogen, Elkins Park, Pa.

[73] Assignee: L. Lawrence Products, Inc., Huntingdon Valley, Pa.

[21] Appl. No.: 09/333,277

[22] Filed: Jun. 15, 1999

[51] Int. Cl.[7] ..... A47G 25/90

[52] U.S. Cl. ..... 294/2; 294/3.6; 24/40; 7/123

[58] Field of Search ..... 294/1.1, 2.3, 3.6, 294/19.1, 24, 99.2, 902; 24/40, 429, 3.12, 507; 7/101, 123

[56] References Cited

U.S. PATENT DOCUMENTS

| | | | |
|---|---|---|---|
| 686,325 | 11/1901 | O'Connor | 24/40 |
| 2,845,297 | 7/1958 | Doop | 294/3.6 |
| 3,017,680 | 1/1962 | Duncan | 294/3.6 |
| 3,276,087 | 10/1966 | Hanson | 294/3.6 |
| 3,355,779 | 12/1967 | Hurst | 294/3.6 |
| 5,347,688 | 9/1994 | Ross | 294/3.6 |
| 5,558,377 | 9/1996 | Blum et al. | 294/19.1 |
| 5,741,035 | 4/1998 | Glass | 294/1.1 |
| 5,855,401 | 1/1999 | Papernik | 294/3.6 |

FOREIGN PATENT DOCUMENTS

| | | | |
|---|---|---|---|
| 298862 | 8/1965 | Netherlands | 294/3.6 |

*Primary Examiner*—Dean J. Kramer

*Attorney, Agent, or Firm*—Caesar, Rivise, Bernstein, Cohen & Pokotilow, Ltd.

[57] ABSTRACT

A combination zipper pull, button fastener or pull, and bracelet fastener. The device basically comprises an elongated body having a zipper-grasping or bracelet-grasping clip (e.g., an alligator type clip having openable jaws) at one end and an elongated button-grasping hook at the other end of the body. The body is formed of plural, e.g., six, telescoping sections which can be extended with respect to one another from a compact, short length, state to an extended, long length, e.g., approximately twenty-inches, state. The clip is mounted on the free end of the innermost section of the extendable telescoping body and can be rotated to any position about the central longitudinal axis of the device. The clip is arranged to be operated to releasably grasp a portion of a zipper or a portion of a bracelet between its jaws. The tips of the jaws are covered with a removable protective covering, e.g., some soft plastic, rubber, etc., to protect the zipper or bracelet portion. The button hook is of a general loop shape to enable it to be extended through a button hole to grasp a button and then pull the button back through the button hole. The button hook has a maximum width, to facilitate its passage through the button hole, but is somewhat resilient to enable it to collapse, if necessary, to fit therethrough.

14 Claims, 3 Drawing Sheets

FIG. 1
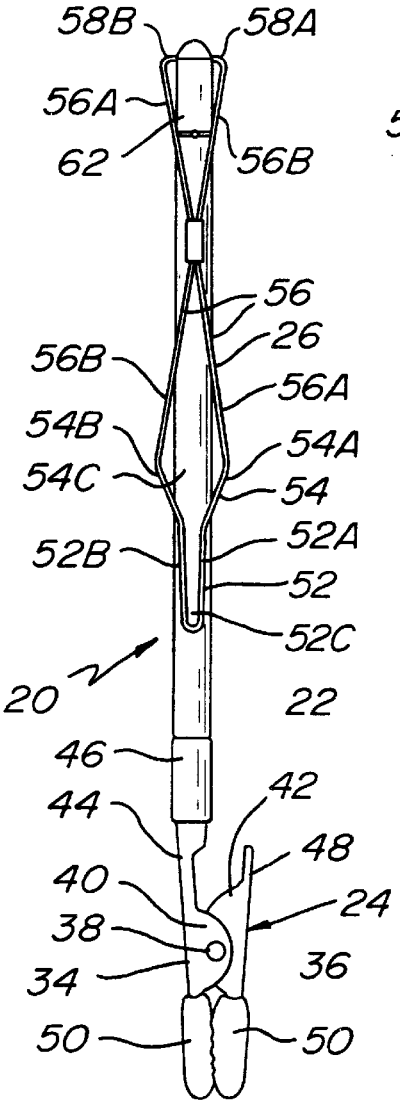
FIG. 2
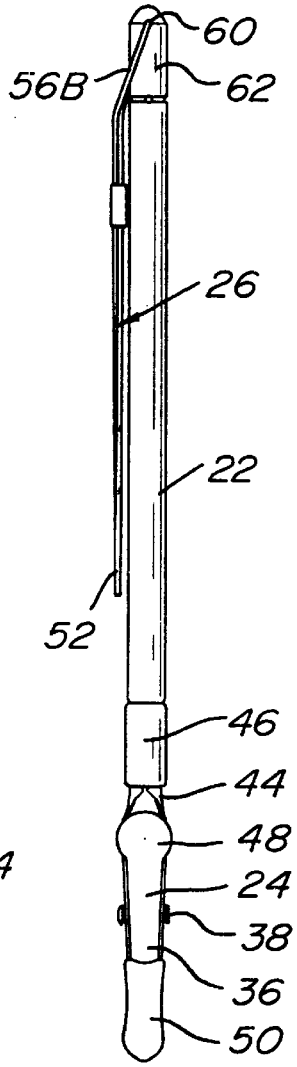
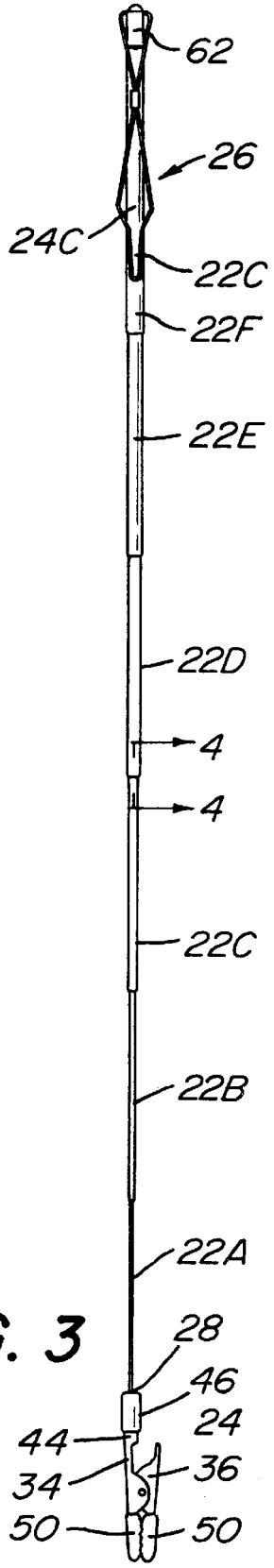
FIG. 3
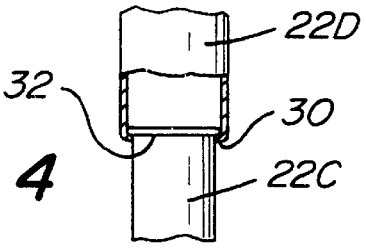
FIG. 4

EXTENDED MULTI-FUNCTION IMPLEMENT FOR FACILITATING DRESSING

BACKGROUND OF THE INVENTION

This invention relates generally to personal dressing aids and more particularly to devices for facilitating or expediting the usage of zippers, buttons and jewelry clasps by persons dressing or undressing.

Various "zipper pull" devices are commercially available and/or have been disclosed in the patent literature. Most of these devices typically make use of some form of releasable engagement member connected to the end of a cord or rod or the like. For example, in U.S. Pat. No. 5,732,447 (Nolen et al.) there is disclosed a combination zipper pull and button fastener. The device basically comprises an elongated wire having an open hook at one end. The hook is arranged for extending into the opening or aperture in the zipper tab. When the hook is inserted in the aperture of the zipper tab, the user ostensibly can pull up or down on the extension to close or open the zipper.

Open ended hook arrangements, like that of the Nolen et al. patent have been found to be somewhat difficult to use in that the hook can frequently become disengaged from the zipper tab, particularly if constant tension is not maintained on the portion of the device, e.g., the cord or rod, to which the hook was connected. Another problem with the open hook zipper pulls is that they are susceptible to catch or snag on the user's clothing. Thus, open-hook type zipper pulls have left much to be desired from the standpoint of utility.

U.S. Pat. No. 4,997,222 (Reed) discloses a zipper pull which was designed to overcome some drawbacks of the prior art open-hook type zipper pulls. To that end, the zipper pull of the Reed patent consists of an elongated shaft with a spirally wound end, which may be tapered. The spiral end is arranged to be readily inserted into the aperture in the pull tab of the zipper to enable the user to pull up or down on the device to thereby open or close the zipper. The wound end of the zipper pull is also designed to enable it to be readily removed from the aperture in the zipper tab when the device is no longer needed.

While the device of the Reed patent may overcome the disengagement problem of the prior art open-hook zipper pulls, it still leaves much to be desired from the standpoints of easy of utility, multi-functionality, and storage-ability.

Another approach to overcoming the disadvantage of open-hook zipper pulls is provided by U.S. Pat. No. 5,603,542 (Walker). That patent discloses a zipper pull having a spring biased extendable prong for insertion into the aperture in the zipper tab to positively secure the zipper pull to the tab. While the Walker device appears suitable for its intended purpose, like the device of the Reed patent, it leaves much to be desired from the standpoints of ease of use, multi-functionality, and storage-ability.

U.S. Pat. No. 5,855,401 (Papernik) discloses a multi-functional dressing tool for assisting in zippering a garment, "threading" a button through a button hole, and assisting in fastening a bracelet around a user's wrist. The Papernik device basically comprises a hollow member including at least one compartment, and having opposite ends. At least one end caps is provided for the hollow member and is arranged to be removably secured to one of ends of the hollow member. One of the end caps includes a pair of clamping jaws for assisting in fastening a bracelet to the user's wrist. The other end cap has another dressing aid secured to it, such as a zipper pull, button threader, emery board, magnifying glass and combinations of those items. In one embodiment the zipper pull comprises a ball chain secured to the end cap and having a spring biased hook element at the opposite end. The zipper pull is arranged to be stored in the hollow compartment until it is ready for use.

While the Papernik device appears suitable for its intended purposes, it still leaves much to be desired from the standpoints of easy of use.

Other prior art zipper pulls are disclosed in U.S. Pat. No. 2,900,205 (Cirone), U.S. Pat. No. 2,926,875 (Hoyte), U.S. Pat. No. 3,249,977 (Cloud, Jr.), and U.S. Pat. No. 5,249,832 (Leonardz).

While the aforementioned prior art may suitable for their intended purposes, a need still exists for multi-function dressing aids which are easy to use and compact.

OBJECTS OF THE INVENTION

Accordingly, it is a general object of this invention to provide a multi-function dressing aid which addresses those needs of the prior art.

It is a further object of this invention to provide a dressing aid which is particularly suitable for assisting in zippering a garment, "threading" a button through a button hole, and assisting in fastening a bracelet around a user's wrist.

It is still a further object of this invention to provide a multi-function dressing aid which is simple in construction.

It is yet a further object of this invention to provide a multi-function dressing aid which is easy to use.

It is yet a further object of this invention to provide a multi-function dressing aid which can be extended from a compact configuration suitable for ease of storage to an extended configuration suitable for ease of use.

SUMMARY OF THE INVENTION

These and other objects of the instant invention are achieved by providing a device for facilitating dressing of a person, e.g., to facilitate pulling on a zipper buttoning a garment, or closing the clasp of a bracelet. The device basically comprising an elongated body having plural, e.g., six, telescoping sections including at least a first section and a second section. The first section has a free end on which an operable clip is mounted. A loop is mounted on the free end of the second section. The sections are arranged to be grasped by a person to extend the sections from a compact collapsed state to an extended state, whereupon the device is of a longer length to facilitate its use. The sections can also be grasped by the person to collapse the sections from the extended state to the collapsed state to facilitate storage of the device.

The clip has a pair of jaws, e.g., the clip is an alligator-type clip, which are arranged to be opened by squeezing portions of them and which are closeable to grasp a portion of a zipper attached to an article of clothing between the clip's jaws, so that the person grasping the body portion may pull the zipper up or down with ease.

The loop is arranged to be extended through an opening in an article of clothing to encircle a button on the article of clothing to enable the button to be pulled by the loop back through the opening in the article of clothing with ease.

In accordance with one preferred aspect of the invention the sections have a central longitudinal axis and the clip is arranged to be rotated about that axis to any desired orientation.

In accordance with another preferred aspect of the invention the sections have a central longitudinal axis and the loop is pivotably mounted on a transverse axis extending perpendicularly to the central longitudinal axis, so that the loop can be positioned to various orientations with respect to the transverse axis, one of the orientations extend alongside the second section.

DESCRIPTION OF THE DRAWING

FIG. 1 is a top plan view of a multi-function device for facilitating dressing of a person constructed in accordance with this invention and shown in its compact state;

FIG. 2 is a side elevational view of the device of in FIG. 1 shown in its compact state;

FIG. 3 is a reduced top plan view of the device of FIG. 1, but shown in its extended state;

FIG. 4 is an enlarged partial sectional view taken along line 4—4 of FIG. 3;

DETAILED DESCRIPTION OF THE PREFERRED EMBODIMENT

Figure 5:
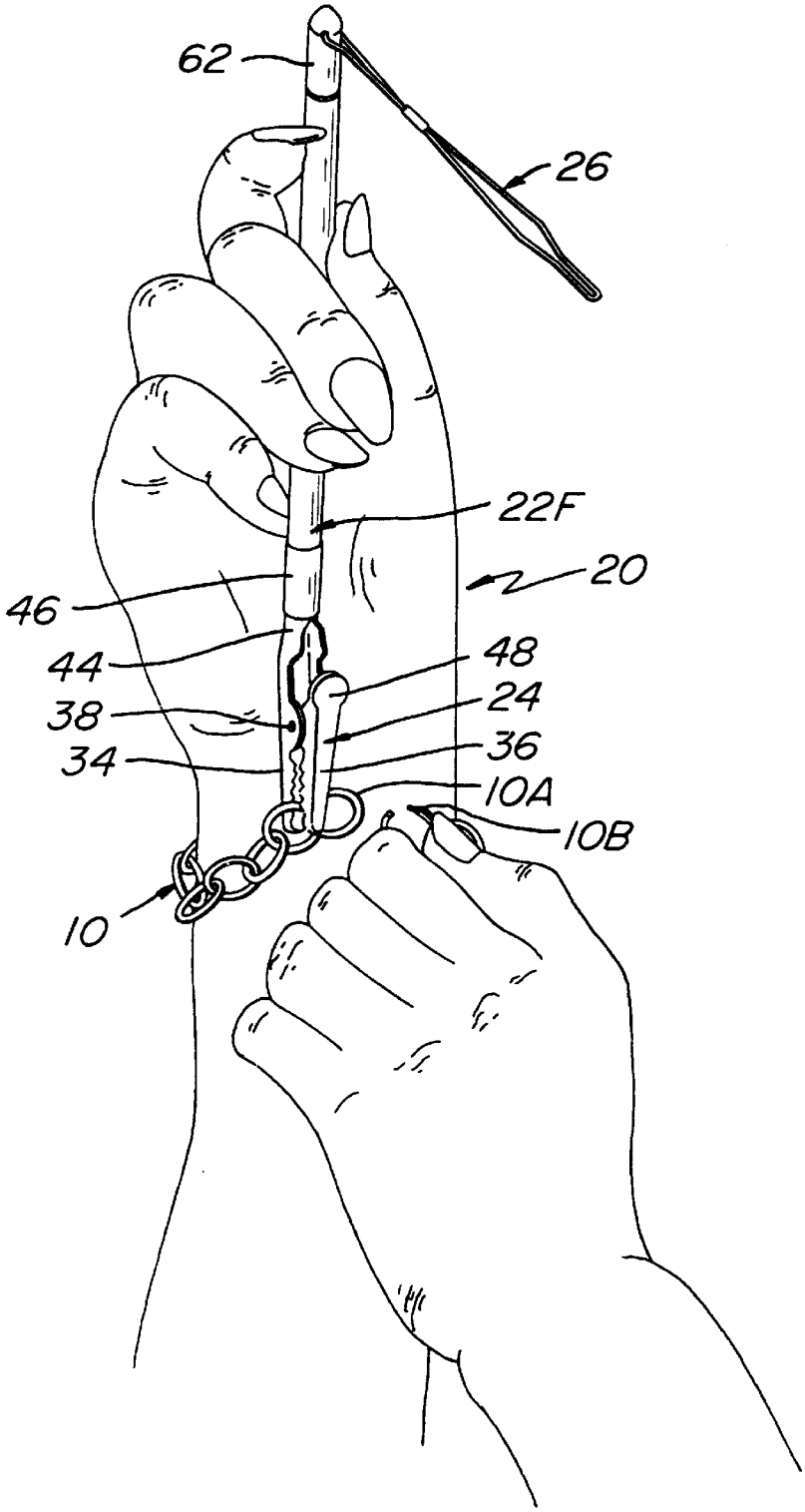
FIG. 5 is an illustrations showing the use of the device of FIG. 1 for aiding a person to put on a bracelet on the person's wrist.

Referring to Figs. there is shown at 20 a multi-function dressing aid constructed in accordance with this invention. The device 20 basically comprises an elongated extendable body 22 having a clamping member or clip 24 at one end and a button hook 26 at the opposite end.

The body 22 is formed of a plurality of telescoping sections 22A, 22B, 22C, 22D, 22E, and 22F. The section 22A is in the form of a thin, linear rod-like body, whereas the remaining sections are in the form of thin-walled linear tubes, each tube being of slightly larger inside diameter to slidingly accommodate within it the body section in front of it. Thus, the section 22F, which typically serves as the portion to be grasped in the hand of the user, accommodates within its interior the section 22E. The section 22E, in turn, accommodates within its interior the section 22D. The section 22D, in turn, accommodates within its interior the section 22C. The section 22C, in turn, accommodates within its interior the section 22B. The section 22B, in turn, accommodates within its interior the section 22A. All of the sections may be rotated about their longitudinal axis to any angled orientation with respect to each other, in addition to being longitudinally slidable with respect to each other.

The rod-like section 22A has a front end 28 and a rear end (not shown) which is located within the hollow interior of the section 22B. The front end of the tubular section 22B includes an inwardly extending annular flange (not shown) but which is similar to that shown in FIG. 4. The inwardly directed flange of tubular section 22B serves as a stop cooperating with a portion of the rear end of the rod-like section 22A to prevent the rod-like section 22A from sliding fully out of the tubular section 22B. In particular, the rear end of the rod-like section 22A includes an outwardly directed annular flange (not shown, but also similar to that shown in FIG. 4) arranged to abut the inwardly directed flange of the tubular section 22B when the rod-like section is fully extended as shown in FIG. 3. The rear end of the tubular section 22B is located within the hollow interior of the tubular section 22C. The front end of the tubular section 22C also includes an inwardly extending annular flange like that of section 22B and which serves as a stop cooperating with a portion of the rear end of the tubular section 22B to prevent the tubular section 22B from sliding fully out of the tubular section 22C. The rear end of the tubular section 22B, also includes an outwardly directed annular flange arranged to abut the inwardly directed flange of the tubular section 22C when the tubular section 22C is fully extended as shown in FIG. 3. The rear end of the tubular section 22C is located within the hollow interior of the tubular section 22D. The front end of the tubular section 22D also includes an inwardly extending annular flange identified by the reference number 30 in FIG. 4 and which serves as a stop cooperating with an outwardly directed flange identified by the reference number 32 in FIG. 4 at the rear end of the tubular section 22C. The cooperating flanges 30 and 32 serve to prevent the tubular section 22C from sliding fully out of the tubular section 22D. The rear end of the tubular section 22D is located within the hollow interior of the tubular section 22E. The front end of the tubular section 22E also includes an inwardly extending annular flange, like flange 30, and which serves as a stop cooperating with a portion of the rear end of the tubular section 22D to prevent the tubular section 22D from sliding fully out of the tubular section 22E. Thus, the rear end of the tubular section 22D also includes an outwardly directed annular flange, like flange 32, arranged to abut the inwardly directed flange of the tubular section 22E. In a similar manner, the rear end of the tubular section 22E is located within the hollow interior of the tubular section 22F. The front end of the tubular section 22F also includes an inwardly extending annular flange, like flange 30, and which serves as a stop cooperating with a portion of the rear end of the tubular section 22E to prevent the tubular section 22E from sliding fully out of the tubular section 22F. Thus, the rear end of the tubular section 22E also includes an outwardly directed annular flange, like flange 32, arranged to abut the inwardly directed flange of the tubular section 22F.

It should be pointed out at this juncture that while the disclosed embodiment of this invention includes six telescoping sections, i.e., sections 22A–22F, such an arrangement is merely exemplary. Thus, any plural number of telescoping sections can be used, with each section being of any desired length. The sections may each be of the same length or different lengths. In the embodiment shown the sections are of similar lengths so that the total extended length of the device 20 is approximately 20 inches (50.8 cms.). The sections 22A–22F may be fabricated of any suitable material, e.g., metal, plastic, etc.

The clip 24 is fixedly secured onto the front end of the rod-like section 22A of the body member 22. Since the rod-like section 22A can be rotated with respect to tubular section 22B, the clip 24 may be oriented at any rotational position with respect to body portion 22F. This feature enables the clip to grasp any item irrespective of its orientation.

The clip 24 is best seen in FIGS. 1 and 2 and is constructed similar to a conventional "alligator" clip. Thus, it includes a pair of jaws 34 and 36 which are pivotally connected together by a pivot pin 38. The pivot pin extends through aligned holes in a pair of tabs 40 located on each side of the jaw 34 at an intermediate point therealong. A similar pair of tabs 42 is located on each side of the jaw 36 at a similar intermediate point. The pair of tabs 42 are disposed between the pair of tabs 40. The rear end 44 of the jaw 34 is fixedly secured, e.g., welded, to a sleeve 46, which is fixedly secured, e.g., welded or swaged, to the front end of the rod-like body section 22A. The rear end of the jaw 36 is in the form of a rounded tab 48 arranged to be pressed by the finger of the user of the device 20, as will be described later.

The front end of each of the jaws is preferably serrated. Together the serrated front ends of the jaws define the "mouth" of the clip 24 therebetween. A torsion or compression spring (not shown) is interposed between the rear end portions of the jaws immediately to the rear of the pivot pin 38. This spring applies a bias force to the rear ends of the jaws to bias the front ends of the jaws closed. The clip 24 may be fabricated of any suitable material, e.g., metal, plastic, etc.

In accordance with one preferred aspect of this invention the serrated front end of each of the jaws 34 and 36 includes a removable protective covering 50, e.g., a elastomeric or plastic material having some "give." When in place the coverings 50 serve to provide a soft or otherwise non-damaging gripping surface for the jaws so that the serrated edges of the jaws are not exposed to damage any jewelry or other fragile item clamped between them. For some applications, to be described later, the coverings may be removed.

Figure 7:
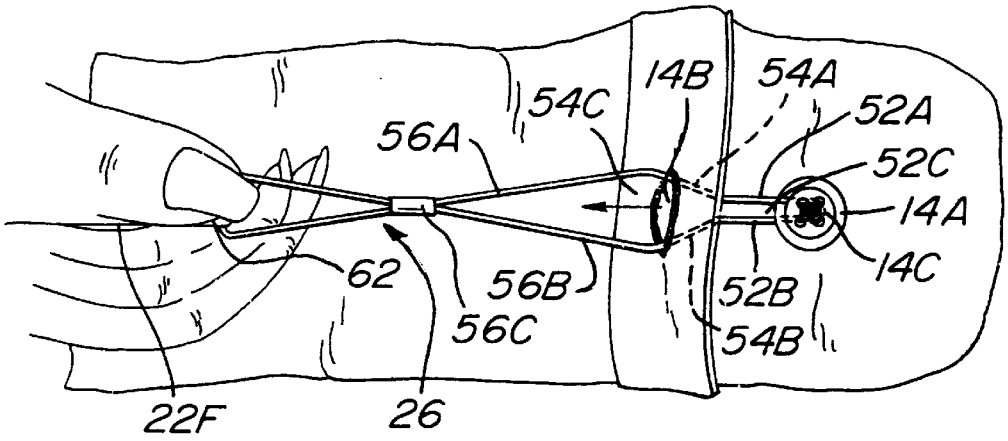
FIG. 7 is an illustrations showing the use of the device of FIG. 1 for aiding a person to pull a button through a button hole.

The button hook 26 is also best seen in FIGS. 1 and 3 and basically comprises a loop of a thin wire which is pivotally connected to the rear end of the body section 22F. The loop basically comprises a narrow generally U-shaped front section 52, a outwardly flaring V-shaped intermediate section 54 and an X-shaped rear section 56. The front section is made up of a pair of coplanar branches 52A and 52B defining a narrow throat 52C therebetween. The intermediate section 54 is made up of a pair of coplanar branches 54A and 54B defining a flaring wide throat 54C therebetween for receipt of a button (as will be described later). The maximum width of the intermediate section is approximately ⅜ of an inch in the exemplary embodiment shown herein. The rear section 56 of the button hook 26 is made up of a pair of coplanar legs 56A and 56B which extend backward from the intermediate section 54 and cross over themselves at a sleeve 56C. The rear end portions of the legs bend downward from the plane of the forward portion of the legs at an acute angle as best seen in FIG. 2. The terminus of the rear portion of the legs 56A and 56B is in the form of inwardly directed pivots 58A and 58B, respectively. The pivots 58A and 58B extend towards each other and are coaxial. Each of the pivots is arranged to be received within a correspondingly shaped bore 60 (FIG. 2) in a cap member 62 mounted at the rear end of the body section 22F. Thus, the button hook 26 can be pivoted from a retracted position (shown in FIG. 2), whereupon the majority of the button hook lies along and parallel to the body section 22F, to an extended position at any angular orientation to the body portion 22F for use of the button hook, e.g., the orientation shown in FIG. 7. Since the hook 26 is formed of a thin wire it is flexible so that the branches making up the intermediate portion 54 may be flexed with respect to each other to facilitate the hook's passage through a button hole, as will be described later.

As should be appreciated from the foregoing when the body section 22A–22F are telescoped together in their compact state, like shown in FIGS. 1 and 2, and the button hook is in its retracted position, like shown in FIG. 2, the multi-function device 20 is quite compact and can be readily and conveniently stored in a purse or some other small holder.

If it is desired to use the device 20 to aid in putting a bracelet 10 on one's wrist the device 20 can be kept in its compact state. All that is required is to squeeze the rear end of the jaws 34 and 36 together between one's fingers to open the mouth of the clip 24 so that one end portion, e.g., loop 10A, of the bracelet can be placed therein and then the jaws are released to trap the bracelet loop between the jaws. Then one merely grasps the tubular body section 22F of the device 20 between one's fingers facing the palm, with the clip 24 holding the bracelet end directed or dangling downward so that it is located over the wrist, like shown in the illustration of FIG. 5. The other end of the bracelet, i.e., the end having an openable clasp 10B, can then be picked up by the fingers of the other hand, opened up, and brought over to the bracelet loop 10A to engage it and thereby secure the a, bracelet in place. The jaws can then be reopened to release the bracelet.

It should be noted that in FIG. 5 the serrated jaws of the bracelet are shown as being exposed, i.e., the protective coverings 50 removed. This arrangement may be desirable in some cases to provide a greater degree of grip onto the bracelet. For most applications, however, it is contemplated that the protective coverings will be left in place to protect the finish on the bracelet or other jewelry gripped by the jaws.

If it is desired to use the device 20 to aid in pulling up a zipper 12 on a garment the device will most likely be extended to some longer extended state. That state may be the fully extended state shown in FIG. 3, or some intermediary extended state, e.g., one in which less than all of the sections are fully extended from one another. The amount of extension of the device will likely depend on the location of the zipper with respect to the user's body.

In order to extend the device to the desired length all that is required is to pull whatever body sections 22A–22F are desired to be extended out from their immediately adjacent section(s) until the length of the device, i.e., the distance between the clip 24 and the body section 22F, is that desired. The jaws of the clip 24 are then opened by squeezing their rear ends together between one's fingers. The zipper's pull tab 12A can be placed between the jaws and the jaws released to trap or clamp the zipper's pull tab in the clip's mouth. Then one merely grasps the tubular body section 22F of the device 20 between one's fingers facing the palm, with the extended clip 24 holding the zipper tab directed downward, like shown in the illustration of FIG. 6. Lifting the body section 22F upward will pull the zipper upward to close the zipper. Unzipping the zipper can be achieved in a similar manner. For example, after clamping the zipper tab within the clip's mouth, the device 20 is oriented so that the body section 22F is directed downward, below the zipper's location. The user then pulls downward on the body section 22F of the device to carry the zipper downward to unzip it.

Figure 6:
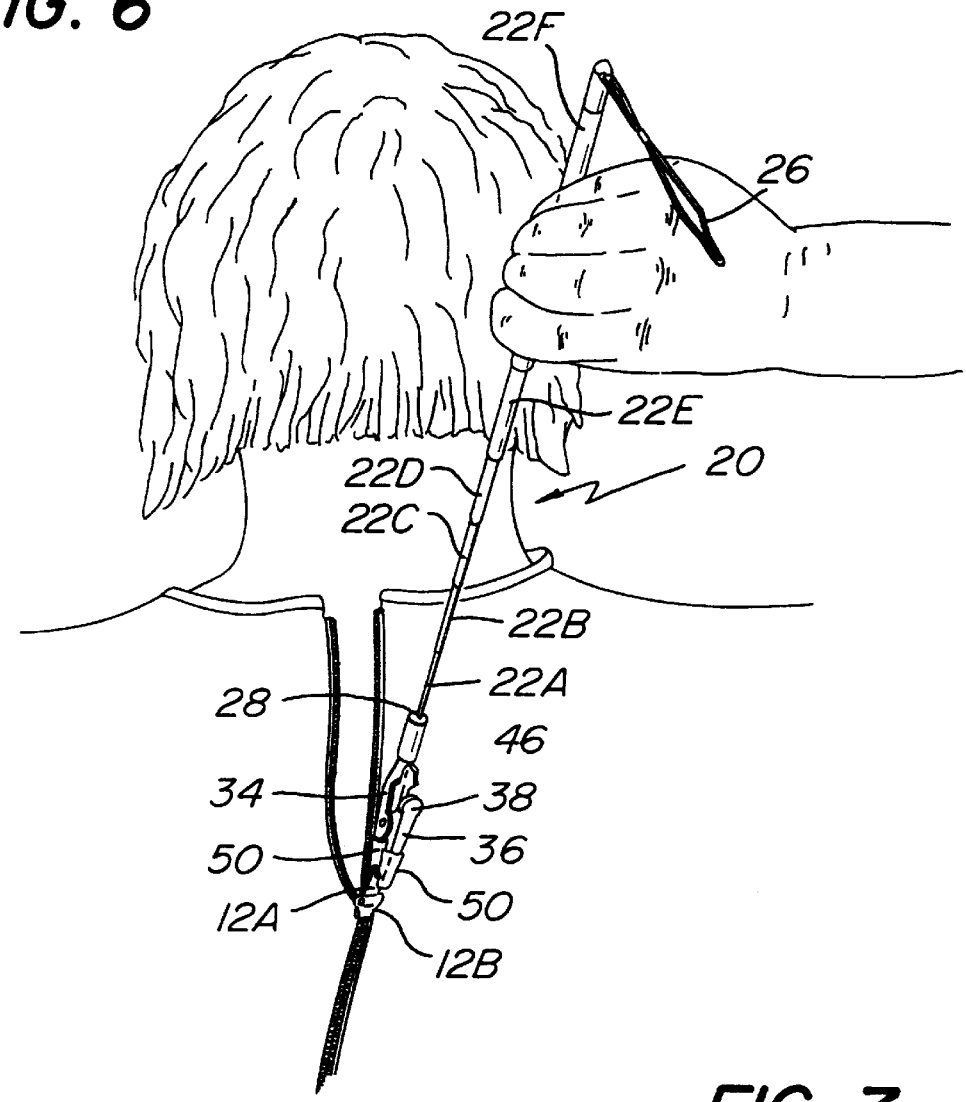
FIG. 6 is an illustrations showing the use of the device of FIG. 1 for aiding a person to pull up a zipper on the back of a garment.

It should be pointed out at this juncture that while the illustration of FIG. 6 shows the jaws of the clip 24 having the protective coverings 50 in place, such an arrangement is merely one exemplary use of the device 20. Thus, it is contemplated that for many uses as a zipper pull the serrated jaws of the device 20 will be exposed, i.e., the protective coverings removed. This arrangement is likely to be desirable to provide a greater degree of grip onto the zipper tab to facilitate the pulling of the zipper.

If it is desired to use the device 20 to aid in buttoning a button 14A in a button hole 14B, the device 20 can likely be kept in its compact state. All that is required is to pivot the button hook 26 from its retracted position like that shown in FIG. 2 to its fully extended position like that shown in FIG. 7. In the fully extended position the hook 26 is generally axially aligned with the body section 22F, but extending in the opposite direction from the clip 24. One then grasps the body section 22F in the palm with the extending button hook 26 between the thumb and index finger, to insert the front end portion 52 of the button hook through the button hole 14B from the outside of the garment inward. The device is moved inward until the button 14A is received in the wide throat 54C portion of the button hook 26. The device 20 is then retracted by pulling backward on the body section 22F in the direction of the arrow shown in FIG. 7 to bring the button-holding threads 14C within confines of the narrow throat 52C at the front end of the button hook 26 as shown therein. Continued retraction of the device 20 pulls the button 14A through the button hole 14B from the inside out. Once the button has been extended through the button hole, all that is required is to remove the button hook 26 from the button.

As should be appreciated from the foregoing the device 20 is a multi-function, e.g., 3 in 1, dressing aid tool which is easy to use, effective, easy to store, and which is of an aesthetically pleasing appearance.

Without further elaboration the foregoing will so fully illustrate my invention that others may, by applying current or future knowledge, adopt the same for use under various conditions of service.

I claim:

1. A device for facilitating dressing of a person, said device comprising an elongated body comprising plural telescoping sections including at least a first section and a second section, said first section having a free end, said second section having a free end, an operable clip secured to said free end of said first sections, and a loop secured to said free end of said second section, said clip having a pair of jaws which are arranged to be closed to grasp a portion of zipper attached to an article of clothing between said jaws or to grasp a portion of a bracelet between said jaws, said loop being a generally elongated planar member pivotably connected to said free end of said second section and being pivotable from a retracted position to an extended position to enable said loop to be readily extended through an opening in an article of clothing to encircle a button on the article of clothing to enable the button to be pulled by said loop back through the opening in the article of clothing, said plural telescoping sections being arranged to be held by the person to be pulled from a collapsed state to an extended state, whereupon said device is of a longer length to facilitate the use of said device, said plural telescoping sections also being arranged to be held by the person to be pushed from said extended state to said collapsed state to facilitate the storage of said device.

2. The device of claim 1 wherein said clip is a spring biased clip arranged to be squeezed by the person to open said jaws, whereupon either a portion of the zipper or a portion of the bracelet may be placed between said jaws, said clip being arranged to be released to cause said jaws to grasp said portion of said zipper or bracelet between them.

3. The device of claim 2 wherein each of said jaws includes a relatively smooth exterior surface portion to prevent damage to the zipper or bracelet portion grasped by said clip.

4. The device of claim 3 wherein each of said jaws is covered with a protective material covering to form said smooth exterior surface.

5. The device of claim 4 wherein said protective material covering is removable.

6. The device of claim 1 wherein said elongated body has a longitudinal central axis along which said sections are arranged to slide with respect to each other, and wherein said clip is mounted for rotation about said longitudinal central axis to any orientation.

7. The device of claim 1 wherein said loop includes a wide throat portion and a narrow throat portion, said wide throat portion being of a sufficient size for a button to extend therethrough.

8. The device of claim 7 wherein said loop is somewhat resilient.

9. The device of claim 1 wherein said loop is mounted for pivoting about a transverse axis, said transverse axis being perpendicular to said longitudinal central axis.

10. The device of claim 9 wherein said loop may be pivoted about said transverse axis so that at least a portion of said loop lies along a portion of second section.

11. The device of claim 1 wherein said body comprises more than two telescoping sections with said first and said second sections forming the respective end sections of said device.

12. The device of claim 1 wherein said body of said device in said extended state is approximately twenty inches (50.8 cms).

13. The device of claim 12 wherein said body of said device comprises six similarly sized sections.

14. The device of claim 1 wherein said body of said device comprises six similarly sized sections.

* * * * *